US008889609B2

(12) United States Patent
Wu et al.

(10) Patent No.: US 8,889,609 B2
(45) Date of Patent: Nov. 18, 2014

(54) CLEANING FORMULATIONS AND METHOD OF USING THE CLEANING FORMULATIONS

(75) Inventors: Aiping Wu, Macungie, PA (US); Yi-Chia Lee, Dansheui Jen (TW); Wen Dar Liu, Hsinchu Hsien (TW); Machukar Bhaskara Rao, Fogelsville, PA (US); Gautam Banerjee, Latham, NY (US)

(73) Assignee: Air Products and Chemicals, Inc., Allentown, PA (US)

( * ) Notice: Subject to any disclaimer, the term of this patent is extended or adjusted under 35 U.S.C. 154(b) by 50 days.

(21) Appl. No.: 13/414,339

(22) Filed: Mar. 7, 2012

(65) Prior Publication Data

US 2013/0061882 A1 Mar. 14, 2013

Related U.S. Application Data

(60) Provisional application No. 61/453,282, filed on Mar. 16, 2011.

(51) Int. Cl.

| | |
|---|---|
| ***C11D 7/50*** | (2006.01) |
| ***C11D 3/20*** | (2006.01) |
| ***C11D 11/00*** | (2006.01) |
| ***C11D 3/00*** | (2006.01) |
| ***C11D 3/30*** | (2006.01) |
| ***C11D 7/26*** | (2006.01) |
| ***C11D 3/43*** | (2006.01) |
| ***C11D 7/06*** | (2006.01) |
| ***C11D 7/32*** | (2006.01) |
| ***C11D 3/28*** | (2006.01) |
| ***C11D 3/04*** | (2006.01) |

(52) U.S. Cl.

CPC ..... *C11D 11/0047* (2013.01); *C11D 3/2034* (2013.01); *C11D 3/0073* (2013.01); *C11D 3/30* (2013.01); *C11D 3/2086* (2013.01); *C11D 7/5004* (2013.01); *C11D 7/261* (2013.01); *C11D 3/43* (2013.01); *C11D 7/06* (2013.01); *C11D 7/3281* (2013.01); *C11D 3/2058* (2013.01); *C11D 7/265* (2013.01); *C11D 3/28* (2013.01); *C11D 7/3218* (2013.01); *C11D 3/044* (2013.01)

USPC ..... 510/175; 510/176; 134/1.3

(58) Field of Classification Search

CPC ..... C11D 11/0047; C11D 7/3218; C11D 3/43

USPC ..... 510/175, 176; 134/1.3

See application file for complete search history.

(56) References Cited

U.S. PATENT DOCUMENTS

| | | | | |
|---|---|---|---|---|
| 5,279,771 | A | 1/1994 | Lee | |
| 5,334,332 | A | 8/1994 | Lee | |
| 5,381,807 | A | 1/1995 | Lee | |
| 5,482,566 | A | 1/1996 | Lee | |
| 5,496,491 | A | 3/1996 | Ward et al. | |
| 5,556,482 | A | 9/1996 | Ward et al. | |
| 5,672,577 | A | 9/1997 | Lee | |
| 5,798,323 | A | 8/1998 | Honda et al. | |
| 5,902,780 | A | 5/1999 | Lee | |
| 5,911,835 | A | 6/1999 | Lee et al. | |
| 6,000,411 | A | 12/1999 | Lee | |
| 6,110,881 | A | 8/2000 | Lee et al. | |
| 6,121,217 | A | 9/2000 | Lee | |
| 6,140,287 | A | 10/2000 | Lee | |
| 6,156,661 | A | 12/2000 | Small | |
| 6,187,730 | B1 | 2/2001 | Lee | |
| 6,221,818 | B1 | 4/2001 | Lee | |
| 6,242,400 | B1 | 6/2001 | Lee | |
| 6,276,372 | B1 | 8/2001 | Lee | |
| 6,319,885 | B1 | 11/2001 | Lee et al. | |
| 6,328,943 | B1 | 12/2001 | Roling et al. | |
| 6,339,551 | B1 | 1/2002 | Bartoli et al. | |
| 6,475,866 | B2 | 11/2002 | Hofmann et al. | |
| 6,475,966 | B1 | 11/2002 | Sahbari | |
| 6,564,812 | B2 | 5/2003 | Lee | |
| 6,825,156 | B2 | 11/2004 | Lee et al. | |
| 6,908,892 | B2 | 6/2005 | Yoon et al. | |
| 6,916,772 | B2 * | 7/2005 | Zhou et al. | 510/201 |
| 6,917,110 | B2 | 7/2005 | Matsubara et al. | |
| 7,051,742 | B2 | 5/2006 | Lee et al. | |

(Continued)

FOREIGN PATENT DOCUMENTS

| | | |
|---|---|---|
| EP | 1813667 | 8/2007 |
| EP | 2290046 A1 | 2/2011 |

(Continued)

OTHER PUBLICATIONS

Taiwanese Search Report No. 101108365.

(Continued)

*Primary Examiner* — Gregory Webb

(74) *Attorney, Agent, or Firm* — Anne B. Kiernan

(57) ABSTRACT

A water-rich hydroxylamine formulation for photoresist and post-etch/post-ash residue removal in applications wherein a semiconductor substrate comprises aluminum. The cleaning composition comprises from about 2 to about 15% by wt. of hydroxylamine; from about 50 to about 80% by wt. of water; from about 0.01 to about 5.0% by wt. of a corrosion inhibitor; from about 5 to about 45% by wt. of a component selected from the group consisting of: an alkanolamine having a pKa<9.0, a water-miscible solvent, and a mixture thereof. Employment of such composition exhibits efficient cleaning capability for Al substrates, minimal silicon etch while protecting aluminum for substrates comprising both materials.

21 Claims, No Drawings

(56) References Cited

U.S. PATENT DOCUMENTS

| | | | | |
|---|---|---|---|---|
| 7,144,849 | B2 | 12/2006 | Lee et al. | |
| 7,205,265 | B2 | 4/2007 | Lee | |
| 7,387,130 | B2 | 6/2008 | Lee et al. | |
| 7,528,098 | B2 | 5/2009 | Lee et al. | |
| 7,543,592 | B2 | 6/2009 | Lee | |
| 7,671,001 | B2 | 3/2010 | Skee | |
| 7,723,280 | B2 | 5/2010 | Brainard et al. | |
| 7,727,420 | B2 | 6/2010 | Ward | |
| 2002/0077259 | A1 | 6/2002 | Skee | |
| 2003/0134234 | A1 | 7/2003 | Wakiya et al. | |
| 2003/0181344 | A1 | 9/2003 | Ikemoto et al. | |
| 2003/0228990 | A1 | 12/2003 | Lee et al. | |
| 2004/0038840 | A1* | 2/2004 | Lee et al. | 510/202 |
| 2004/0067860 | A1 | 4/2004 | Lee | |
| 2004/0147421 | A1* | 7/2004 | Charm et al. | 510/176 |
| 2004/0198621 | A1 | 10/2004 | Lee et al. | |
| 2004/0220065 | A1 | 11/2004 | Hsu | |
| 2005/0119143 | A1* | 6/2005 | Egbe et al. | 510/175 |
| 2006/0003910 | A1* | 1/2006 | Hsu et al. | 510/176 |
| 2007/0060490 | A1* | 3/2007 | Skee | 510/175 |
| 2007/0232513 | A1 | 10/2007 | Hsu | |
| 2009/0112024 | A1 | 4/2009 | Lee | |
| 2009/0118153 | A1* | 5/2009 | Rath et al. | 510/176 |
| 2009/0120457 | A1* | 5/2009 | Naghshineh et al. | 134/2 |
| 2009/0176685 | A1 | 7/2009 | Ward | |
| 2009/0203566 | A1* | 8/2009 | Lee et al. | 510/175 |

FOREIGN PATENT DOCUMENTS

| | | | |
|---|---|---|---|
| EP | 2 290 046 | A1 | 3/2011 |
| JP | 09-096911 | | 4/1997 |
| JP | 2001-188363 | | 7/2001 |
| JP | 2003-223010 | | 8/2003 |
| JP | 2007-128038 | | 5/2007 |
| KR | 201125609 | A | 3/2011 |
| TW | I293646 | | 2/2008 |
| WO | 9960083 | A1 | 11/1999 |

OTHER PUBLICATIONS

Hungarian Intellectual Property Office Search Report dated Nov. 10, 2013.

* cited by examiner

CLEANING FORMULATIONS AND METHOD OF USING THE CLEANING FORMULATIONS

This application claims the benefit of U.S. Provisional Application No. 61/453,282, filed 16 Mar. 2011 which is entirely incorporated herein by reference.

BACKGROUND OF THE INVENTION

The present invention provides cleaning compositions that can be used for a variety of applications including, for example, removing unwanted resist films, post-etch, and post-ash residue on a semiconductor substrate. In particular, the present invention provides cleaning compositions that are particularly useful for back-end-of-the-line operations that minimize the use of organic components.

The background of the present invention will be described in connection with its use in cleaning applications involving the manufacture of integrated circuits. It should be understood, however, that the use of the present invention has wider applicability as described hereinafter.

In the manufacture of integrated circuits, it is sometimes necessary to etch openings or other geometries in a thin film deposited or grown on the surface of silicon, gallium arsenide, glass, or other substrate located on an in-process integrated circuit wafer. Present methods for etching such a film require that the film be exposed to a chemical etching agent to remove portions of the film. The particular etching agent used to remove the portions of the film depends upon the nature of the film. In the case of an oxide film, for example, the etching agent may be hydrofluoric acid. In the case of a polysilicon film, it will typically be hydrofluoric acid or a mixture of nitric acid and acetic acid.

In order to assure that only desired portions of the film are removed, a photolithography process is used, through which a pattern in a computer drafted photo mask is transferred to the surface of the film. The mask serves to identify the areas of the film which are to be selectively removed. This pattern is formed with a photoresist material, which is a light sensitive material spun onto the in-process integrated circuit wafer in a thin film and exposed to high intensity radiation projected through the photo mask. The exposed or unexposed photoresist material, depending on its composition, is typically dissolved with developers, leaving a pattern which allows etching to take place in the selected areas, while preventing etching in other areas. Positive-type resists, for example, have been extensively used as masking materials to delineate patterns on a substrate that, when etching occurs, will become vias, trenches, contact holes, etc.

Increasingly, a dry etching process such as, for example, plasma etching, reactive ion etching, or ion milling is used to attack the photoresist-unprotected area of the substrate to form the vias, trenches, contact holes, etc. As a result of the plasma etching process, photoresist, etching gas and etched material by-products are deposited as residues around or on the sidewall of the etched openings on the substrate.

Such dry etching processes also typically render the photoresist extremely difficult to remove. For example, in complex semiconductor devices such as advanced DRAMS and logic devices with multiple layers of back end lines of interconnect wiring, reactive ion etching (RIE) is used to produce vias through the interlayer dielectric to provide contact between one level of silicon, silicide or metal wiring to the next level of wiring. These vias typically expose, Al, AlCu, Cu, Ti, TiN, Ta, TaN, silicon or a silicide such as, for example, a silicide of tungsten, titanium or cobalt. The RIE process leaves a residue on the involved substrate comprising a complex mixture that may include, for example, re-sputtered oxide material, polymeric material derived from the etch gas, and organic material from the resist used to delineate the vias.

Additionally, following the termination of the etching step, the photoresist and etch residues must be removed from the protected area of the wafer so that the final finishing operation can take place. This can be accomplished in a plasma "ashing" step by the use of suitable plasma ashing gases. This typically occurs at high temperatures, for example, above 200° C. Ashing converts most of the organic residues to volatile species, but leaves behind on the substrate a predominantly inorganic residue. Such residue typically remains not only on the surface of the substrate, but also on inside walls of vias that may be present. As a result, ash-treated substrates are often treated with a cleaning composition typically referred to as a "liquid stripping composition" to remove the highly adherent residue from the substrate. Finding a suitable cleaning composition for removal of this residue without adversely affecting, e.g., corroding, dissolving or dulling, the metal circuitry has also proven problematic. Failure to completely remove or neutralize the residue can result in discontinuances in the circuitry wiring and undesirable increases in electrical resistance.

Cleaning compositions containing dimethyl acetamide (DMAC) are used widely for removing residue from semiconductor substrates. DMAC is particularly suitable for such applications because it is highly polar, which makes it an excellent solvent for organic residues. DMAC is also desirable because it has a high flashpoint, it is water miscible, it has a low viscosity, and it is relatively inexpensive. Unfortunately, however, DMAC is classified as a toxic material in both the United States and in Europe. In this regard, DMAC has an NPFA health rating of 2 and its MSDS indicates that it is easily absorbed through the skin. Toxicity data also suggests that DMAC may be an embryotoxin and, as such, its use has been discouraged in Europe and has received extensive scrutiny in the United States and Asia. As a result, the electronic industry, for example, will not use cleaning compositions that include DMAC.

Where cleaning of semiconductor substrates comprising aluminum is concerned such as, for example, in Al BEOL (back-end-of the-line) cleaning of ashed and unashed substrates, conventional compositions typically contain 5-50% hydroxylamine, 10-80% (alkanolamine and/or a solvent), up to 30% chelating agent and water, with water being a relatively minor component. Such compositions being largely organic, however, require an additional rinsing step (i.e., an intermediate rinsing step) such as, for example, an isopropyl alcohol rinsing step prior to a final water rinse to avoid water-induced aluminum corrosion.

Therefore, there is a need in the art for a cleaning composition that is non-toxic and environmentally friendly for back-end cleaning operations including stripping photoresist and plasma ash residue such as, for example, those generated by plasma processes without suffering from the above-identified drawbacks. There is a particular need for a water-rich hydroxylamine-containing cleaning composition that has a cleaning efficiency comparable to conventional high organic content based cleaning compositions that removes etch residues while not changing the critical dimensions of the metal structures on the substrate.

BRIEF SUMMARY OF THE INVENTION

The present invention satisfies this need by providing a composition useful for removing residue from a semiconductor substrate comprising, consisting essentially of and/or consisting of: from about 2 to about 15% by wt. (or from about 2 to about 10 or to about 12% by wt.) of hydroxylamine ($NH_2OH$); from about 55 to about 80% (or from about 50 to about 80%) by wt. of water; from about 0.01 to about 5.0% by wt. of a corrosion inhibitor; from about 5 to about 42 or to about 45% by wt. of a component selected from the group consisting of: an alkanolamine having a pKa<9.0, a water-miscible organic solvent, and a mixture thereof.

In another aspect, the present invention provides a composition useful for removing residue from a semiconductor substrate, the composition comprising, consisting essentially of and/or consisting of: from about 4 to about 10% by wt. or from about 4 to about 12 or to about 15% by wt. of hydroxylamine; from about 60 to about 80% by wt. of water; from about 0.01 to about 5.0% by wt. (or about 0.1 to about 1.0% by wt.) of a corrosion inhibitor; from about 10 to about 25% by wt. of a water-miscible organic solvent; and from about 0 to about 30% by wt. (or from about 0 to about 25% by wt.) of an alkanolamine having a pKa<9.0.

In another aspect, the present invention provides a method for removing residue from a substrate comprising aluminum and silicon, the method comprising the steps of: contacting the substrate with a cleaning composition comprising, consisting essentially of and/or consisting of: from about 2 to about 10% by wt. (or from about 2 to about 12 or to about 15% by wt.) of hydroxylamine; from about 50 to about 80% (or from about 55 to about 80%) by wt. of water; from about 0.01 to about 5.0% by wt. of a corrosion inhibitor; from about 5 to about 42 or to about 45% by wt. of a component selected from the group consisting of: an alkanolamine having a pKa<9.0, a water-miscible organic solvent, and a mixture thereof; rinsing the substrate with water; and drying the substrate, wherein the method excludes an intermediate IPA rinse step prior to the step of rinsing the substrate with water.

For each of the embodiments described above, the corrosion inhibitor may be selected from the group consisting of one or more linear or branched $C_1$-$C_6$ alkyl dihydroxybenzenes, one or more hydroxyquinolines or mixtures thereof. In some embodiments, the corrosion inhibitor is selected from the group consisting of one or more linear or branched $C_1$-$C_6$ alkyl dihydroxybenzenes, or one or more hydroxyquinolines, but not mixtures of linear or branched $C_1$-$C_6$ alkyl dihydroxybenzenes and hydroxyquinolines. For each of the embodiments described herein there may be only a single corrosion inhibitor (meaning only one corrosion inhibitor is present, and no mixtures of types of or individual corrosion inhibitors are present) in the formulation.

Preferred compositions of the present invention may have excellent cleaning properties, be less toxic, and/or be more environmentally acceptable than compositions that are currently being used in the semiconductor industry. Moreover, preferred compositions of the present invention demonstrate compatibility with aluminum-containing substrates and low aluminum and silicon etch rates.

DETAILED DESCRIPTION OF THE INVENTION

Cleaning formulations are needed for Al BEOL (back-end-of the-line) cleaning of ashed and unashed substrates. It is well known to those in the art that a key property of an effective cleaner is its ability to attack and dissolve post-etch and post-ash residues without substantially attacking the underlying interconnect silicon or polysilicon; dielectric or metals; the selection of corrosion inhibitor is the key to controlling the metal etch rate.

Aluminum is electrochemically very active, it is most susceptible to corrosion and/or etching. For Al interconnect structures, the corrosion inhibitor must be able to inhibit etching of aluminum and other interconnect metals, but it is not known how to prevent or reduce silicon etching which for some applications is very important.

Conventional cleaning formulations typically contain a hydroxylamine, a solvent (optional), an alkanolamine (optional), water and a corrosion inhibitor or chelating agent. In the prior art, one way of modulating the corrosive effect of hydroxylamines (and amines) in cleaning formulations is by keeping the water level low and using a high concentration of solvent, thus solvent-rich formulations. Catechol has been known to be employed as a corrosion inhibitor for aluminum and/or chelating agent to extend the stability of hydroxylamine-containing solvent-rich formulation.

The present invention provides a composition whose components are present in amounts that effectively remove residue from a substrate such as, for example, a semiconductor substrate. In applications concerning semiconductor substrates, such residues include, for example, photoresist residues, ash residues, and etch residues such as, for example, residues caused by reactive ion etching. Moreover, a semiconductor substrate typically also includes metal, silicon, silicate and/or inter-level dielectric material such as deposited silicon oxides, which will also come into contact with the cleaning composition. Typical metals include copper, copper alloy, titanium, titanium nitride, tantalum, tantalum nitride, aluminum and/or aluminum alloy. The preferred cleaning compositions of the present invention are compatible with such materials as they exhibit a low metal and/or silicon (or polysilicon) etch rate.

The cleaning compositions of the present invention may comprise, consist essentially of and/or consist of: from about 2 to about 10% (or to about 12 or 15%) by wt. of hydroxylamine; from about 50 (or from about 55) to about 80% by wt. of water; from about 0.01 to about 5.0% by wt. of a corrosion inhibitor; from about 5 to about 45% (or to about 42%) by wt. of a component selected from the group consisting of: an alkanolamine having a pKa<9.0, a water-miscible solvent, and a mixture thereof. "Consisting essentially of" when used to describe a claimed composition of the invention means that the composition has the components listed in the weight percentages listed, but the compositions may also constitute components that are not listed in a claim; with the caveat that any components added to the claimed composition will have little or no effect on the etch rates of the metals (for example aluminum) and silicon by the claimed composition. For example, a composition with additional components added thereto is still within the claimed composition if the Al and Si etch rates each change by 10 Å/min or less as compared to the claimed composition not having the additional components therein. Examples of components that may be added to the compositions of this invention may be referred to as additives and include chelating agents, surfactants, biocides and stabilizers. Typically each additive is present in the composition from 0 to about 10 wt % or from 0 to about 5 wt % or from 0.01 to about 10 wt % or from 0.1 to about 5 wt %. Typically the total additives do not exceed 10 wt % of the composition.

The cleaning compositions of the present invention are aqueous-based and, thus, comprise water as the largest component in terms of weight percent of a composition. In the present invention, water may function in various ways such as, for example, to dissolve one or more solid components of the composition, as a carrier of the components, as an aid to facilitate the removal of inorganic salts and complexes, as a viscosity modifier of the composition, and as a diluent. Preferably, the water employed in the cleaning composition is de-ionized (DI) water or otherwise purified water.

It is believed that, for most applications, water will suitably constitute, for example, from about 55 to about 80% by wt. of the cleaning composition. Other preferred embodiments of the present invention could comprise from about 60 to about 80% by wt. of water. Yet other preferred embodiments of the present invention could comprise from about 60 to about 70% by wt. of water. Such compositions having a large percentage of water are also referred to herein as "water-rich compositions."

The cleaning compositions of the present invention comprise from about 2 to about 10% (or from about 2 to about 12 or to about 15%) by wt. of hydroxylamine. In preferred embodiments, the hydroxylamine is present from about 4 to about 10% by wt., and most preferable from about 5 to about 7.5% by wt. in the compositions of the present invention. In such compositions, the hydroxylamine may function in a variety of ways such as, for example, as a redox agent to reduce metal-containing residues to lower oxidation states, thereby making the residues more soluble in the cleaning compositions.

The cleaning compositions of the present invention suitably comprise from about 5 to about 45 (or to about 42) % by wt. of a component selected from the group consisting of: an alkanolamine having a pKa<9.0, a water-miscible organic solvent, and a mixture thereof.

In embodiments where the alkanolamine having a pKa<9.0 is present, the alkanolamine is preferably present in an amount of from about 5 to about 42 or to about 45% by wt., about 5 to about 25% by wt., or from about 10 to about 25% by wt. or from about 15 to about 25% by wt. in the compositions of the present invention. In such compositions, the alkanolamine having a pKa<9.0 may function in a variety of ways such as, for example, to remove organic residue through penetration and swelling, and to dissolve acidic resist and residue due to basicity. In some embodiments having the alkanolamine therein, the compositions may be solvent-free, that is, the compositions may have no organic solvent present therein.

Alkanolamines having a pKa<9.0 include, for example, triethanolamine, diethanolamine, diisopropanolamine, N-methyldiethanolamine, and mixtures thereof. Triethanolamine is the preferred alkanolamine having a pKa<9.0. In some embodiments, a single alkanolamine (only one individual alkanolamine) is present in the composition.

In embodiments where the water-miscible organic solvent is present, the amount of water-miscible organic solvent will suitably comprise from about 5 to about 42 or to about 45% by wt. of the composition. In some embodiments, the solvent comprises from 5 to about 30% by wt. and, in other embodiments, from about 10% to about 25% by wt. or from about 18% to about 22% by wt. or about 20% by wt. of the composition. In some embodiments where the water-miscible organic solvent is present, the composition may be alkanolamine-free, meaning that there is no alkanolamine in the composition. Alternatively, other embodiments having alkanolamine, having a pKa<9.0, may be water-miscible organic solvent-free, meaning that there is no water-miscible organic solvent in the composition.

Water-miscible organic solvents for use in accordance with the present invention include, for example, ethylene glycol, propylene glycol, 1,4-butanediol, tripropylene glycol methyl ether, propylene glycol propyl ether, diethylene glycol n-butyl ether (e.g. commercially available under the trade designation Dowanol® DB), dimethylsulfoxide, tetrahydrofurfuryl alcohol, glycerol, benzyl alcohol, dimethylurea, dipropylene glycol monomethyl ether, n-methylpyrrolidone, tetramethoxyethane, and mixtures thereof. Preferred solvents include ethylene glycol, propylene glycol, benzyl alcohol, dimethyl sulfoxide, dimethylurea, glycerol, dipropylene glycol monomethyl ether, n-methylpyrrolidone, tetrahydrofurfural alcohol, tetramethoxyethane, and mixtures thereof.

In preferred embodiments, the water-miscible organic solvent is selected from the group consisting of: ethylene glycol, propylene glycol, benzyl alcohol, dimethyl sulfoxide, dimethylurea, glycerol, dipropylene glycol monomethyl ether, n-methyl pyrrolidone, tetrahydrofurfural alcohol, tetramethoxyethane, and mixtures thereof. Propylene glycol is the most preferred water-miscible organic solvent. In some embodiments, propylene glycol is used as the only water miscible organic solvent, and may also be used in a composition that is alkanolamine-free.

In embodiments of the present invention wherein a mixture of an alkanolamine having a pKa<9.0 and a water-miscible organic solvent are employed, the sum of each component of the alkanolamine/solvent mixture should preferably be from about 5 to about 42 or to about 45%, or from about 15 to about 38% by wt. of the composition. Any of the above-recited alkanolamines and solvents can be mixed. The alkanolamine and the solvent can be mixed at any ratio such as, for example, 1:1, 2:1, 1:2, 3:1, 1:3, 4:1, 1:4, 5:1, 1:5, 6:1, 1:6, 7:1, 1:7, 8:1, 1:8, 9:1, 1:9, 10:1, and 1:10. A mixture of triethanolamine and propylene glycol is preferred when a mixture is employed.

Because either of the water-miscible organic solvent and the alkanolamine having a pKa<9.0 may not be present in the compositions of the present invention, another way to state this is that each component may be present from 0 to about 42 or to about 45% by wt. or from 0 to about 40% by wt. in the composition.

The cleaning compositions of the present invention also include a corrosion inhibitor. Examples of corrosion-inhibitors include aromatic hydroxyl compounds, alkyl dihydroxybenzenes, hydroxyquinolines, carboxyl group-containing organic compounds and anhydrides thereof, and triazole compounds. Preferred corrosion inhibitors according to the present invention are selected from the group consisting of $C_1$-$C_6$ alky dihydroxybenzenes, hydroxyquinolines, and mixtures thereof. Preferred alkyl dihydroxybenzenes include linear or branched $C_1$-$C_6$ alkyl dihydroxybenzenes such as, for example, tert-butyl catechol, catechol, gallic acid, 2,3 dihydroxy naphthalene, 2,3-dihydroxy tetraline, and mixtures thereof, more preferably tert-butyl catechol, gallic acid, 2,3 dihydroxy naphthalene, 2,3-dihydroxy tetraline, and mixtures thereof, preferably tert-butyl catechol, 2,3 dihydroxy naphthalene and 2,3-dihydroxy tetraline. Some embodiments are catechol-free. Preferred hydroxyquinolines include 2-hydroxyquinoline, 4-hydroxyquinoline, 6-hydroxyquinoline, 8-hydroxyquinoline, and mixtures thereof. The preferred corrosion inhibitor is tert-butyl catechol. In some embodiments a single corrosion inhibitor is used in each composition. In some embodiments, only a single corrosion inhibitor is used and it is tert-butyl catechol.

It is believed that for most applications, the corrosion inhibitor will comprise from about 0.01 to about 5% by weight of the composition; preferably it comprises from about 0.01 to about 3% by weight, most preferably, from about 0.1 to about 1.5% by weight or from about 0.1 about 1% by weight of the composition.

An optional ingredient that can be employed in the cleaning compositions of the present invention is a metal chelating agent; it can function to increase the capacity of the composition to retain metals in solution and to enhance the dissolution of metallic residues. Typical examples of chelating agents useful for this purpose are the following organic acids and their isomers and salts: (ethylenedinitrilo)tetraacetic acid (EDTA), butylenediaminetetraacetic acid, (1,2-cyclohexylenedinitrilo-)tetraacetic acid (CyDTA), diethylenetriaminepentaacetic acid (DETPA), ethylenediaminetetrapropionic acid, (hydroxyethyl)ethylenediaminetriacetic acid (HEDTA), N,N,N',N'-ethylenediaminetetra(methylenephosphonic) acid (EDTMP), triethylenetetraaminehexaacetic acid (TTHA), 1,3-diamino-2-hydroxypropane-N,N,N',N'-tetraacetic acid (DHPTA), methyliminodiacetic acid, propylenediaminetetraacetic acid, nitrilotriacetic acid (NTA), citric acid, tartaric acid, gluconic acid, saccharic acid, glyceric acid, oxalic acid, phthalic acid, maleic acid, mandelic acid, malonic acid, lactic acid, salicylic acid, catechol, gallic acid, propyl gallate, pyrogallol, 8-hydroxyquinoline, and cysteine. Preferred chelating agents are aminocarboxylic acids such as EDTA, CyDTA and aminophosphonic acids such as EDTMP.

It is believed that, for most applications, the chelating agent (which is one type of additive) will be present in the composition in an amount of from 0 to about 5% by weight, preferably in an amount of from about 0.1 to 2% by weight of the composition. Other additives including surfactants, biocides and the like may be used in the compositions of this invention as discussed above. Some embodiments are additive-free meaning they have no additives therein. Some embodiments are free of fluorine-containing compounds and/or free of quaternary ammonium compounds and/or free of sulfur-containing compounds and/or free of oxidizers, meaning the compositions do not contain fluorine-containing compounds and/or quaternary ammonium compounds and/or sulfur-containing compounds and/or oxidizers.

In one embodiment of the present invention, a composition useful for removing residue from a semiconductor substrate comprises, consists essentially of and/or consists of: from about 4 to about 10% by wt. (or from about 4 to about 12 or to about 15% by wt.) of hydroxylamine; from about 60 to about 80% by wt. of water; from about 0.1 to about 1.0% by wt. of a corrosion inhibitor; from about 10 to about 25% by wt. of a water-miscible solvent; and from about 0 to about 30% by wt. of an alkanolamine having a pKa<9.0. In one embodiment of the present invention, a composition useful for removing residue from a semiconductor substrate comprises, consists essentially of and/or consists of: from about 4 to about 10% by wt. (or from about 4 to about 12 or to about 15% by wt.) of hydroxylamine; from about 60 to about 80% by wt. of water; from about 0.1 to about 1.0% by wt. of a corrosion inhibitor; from about 10 to about 25% by wt. of a water-miscible solvent.

In another embodiment of the present invention, a composition useful for removing residue from a semiconductor substrate comprises, consists essentially of and/or consists of: from about 4 to about 10% by wt. of hydroxylamine; from about 60 to about 80% by wt. of water; from about 0.1 to about 1.0% by wt. of a corrosion inhibitor; from about 0 to about 30% by wt. of a water-miscible solvent; and from about 10 to about 25% by wt. of an alkanolamine having a pKa<9.0. In another embodiment of the present invention, a composition useful for removing residue from a semiconductor substrate comprises, consists essentially of and/or consists of: from about 4 to about 10% by wt. of hydroxylamine; from about 60 to about 80% by wt. of water; from about 0.1 to about 1.0% by wt. of a corrosion inhibitor; from about 10 to about 25% by wt. of an alkanolamine having a pKa<9.0. The invention further includes compositions useful for removing residue from a semiconductor substrate comprising, consisting of or consisting essentially of: from about 2 to about 12 (or to about 15) %, or from about 2 to about 10%, or from about 4 to about 10%, or from about 1 to about 10%, or from about 5 to about 7.5% by wt. hydroxylamine; from about 50 to about 80%, or about 55 to about 80%, or from about 60 to about 80%, or from about 60 to about 70% by wt. of water; from about 0.01 to about 5.0%, or from about 0.01 to about 3%, or from about 0.1 to 1% by wt. of corrosion inhibitor; from about 5 to about 42 or to about 45% by wt. of a component selected from the group consisting of: an alkanolamine having a pKa<9.0, a water-miscible solvent, and a mixture thereof, wherein said alkanolamine is present from about 5 to about 42 or to about 45%, or from about 5 to about 25%, or from about 10 to about 25%, or from about 0 to about 42 or to about 45% by weight, and said water-miscible solvent is present from about 5 to about 42 or to about 45%, or from about 5 to about 30%, or from about 10 to about 25%, or from about 0 to about 42 or to about 45% by weight; and from about 0 to about 5% or from about 0.1 to about 2% by weight metal-chelating agent, with or without other additives; wherein all of the wt. (weight) percentages are of the total composition. Note that the alkanolamine and the water-miscible solvent, if both present in the composition can further be used in any of the ratios described in the specification in combination with all of the defined weight percentages. Any of the compositions described herein are useful in the methods of this invention. The cleaning composition of the present invention is typically prepared by mixing the components together in a vessel at room temperature until all solids have dissolved in the aqueous-based medium.

The cleaning composition of the present invention can be used to remove from a substrate undesired residue. It is believed that the composition can be used to particularly good advantage in cleaning a semiconductor substrate on which residue is deposited or formed during the process for manufacturing semiconductor devices; examples of such residue include resist compositions in the form of films (both positive and negative) and etching deposits formed during dry etching, as well as chemically degraded resist films. The use of the composition is particularly effective when the residue to be removed is a resist film and/or an etching deposit on a semiconductor substrate having a metal film-exposed surface. Examples of substrates that can be cleaned by use of the preferred composition of the present invention without attacking the substrates themselves include metal substrates, for example: aluminum titanium/tungsten; aluminum/silicon; aluminum/silicon/copper; silicon oxide; silicon nitride; and gallium/arsenide. Such substrates typically include residues comprising photoresists and/or post etch deposits. This invention is particularly useful for cleaning substrates that require a low silicon or low silicon and low aluminum etch rates. The use of the compositions of this invention in the method of this invention provide etch rates for silicon and aluminum that are less than about 20 Å/min or less than about 10 Å/min or less than about 5 Å/min or less than about 2 Å/min when measured by the methods that are described below in the examples using a composition at 60° C.

Examples of resist compositions that can be effectively removed by use of the cleaning composition of the present invention include photoresists containing esters or orthonaphthoquinones and novolak-type binders and chemically amplified resists containing blocked polyhydroxystyrene or copolymers of polyhydroxystyrene and photoacid generators. Examples of commercially available photoresist compositions include Clariant Corporation AZ 1518, AZ 4620, Shipley Company, Inc. photoresists, S1400, APEX-E™ positive DUV, UV5™ positive DUV, Megaposit™ SPR™ 220 Series; JSR Microelectronics photoresists KRF® Series, ARF® Series; and Tokyo Ohka Kogyo Co., Ltd. Photoresists TSCR Series and TDUR-P/N Series.

The preferred cleaning compositions can be used to remove post-etch and ash, other organic and inorganic residues as well as polymeric residues from semiconductor substrates at relatively low temperatures with little corrosive effect. The cleaning composition should be applied to the surface for a period of time to sufficient to obtain the desired cleaning effect. The time will vary depending on numerous factors, including, for example, the nature of the residue, the temperature of the cleaning composition and the particular cleaning composition used. In general, the cleaning composition can be used, for example, by contacting the substrate at a temperature of from about 25° C. to about 85° C. for a period of time ranging from about 1 minute to about 1 hour followed by rinsing the cleaning composition from the substrate and drying the substrate.

Accordingly, in another aspect, the present invention provides a method for removing residue from a substrate comprising aluminum and silicon, the method comprising the steps of: contacting the substrate with a cleaning composition as described above; rinsing the substrate with water; and drying the substrate, wherein the method excludes an intermediate IPA rinse step prior to the step of rinsing the substrate with water.

The contacting step can be carried out by any suitable means such as, for example, immersion, spray, or via a single wafer process; any method that utilizes a liquid for removal of photoresist, ash or etch deposits and/or contaminants can be used.

The rinsing step with water, de-ionized or otherwise purified water, is carried out by any suitable means, for example, rinsing the substrate with the de-ionized water by immersion or spray techniques. Prior art hydroxylamine-based cleaning compositions require at least one intermediate rinse step (i.e., a rinse step prior to the final rinse step) to avoid water-induced aluminum corrosion. The method of the present invention, which employs the compositions of the present invention, eliminates the intermediate rinse step without introducing aluminum corrosion when aluminum is present on the substrate. Moreover, prior art amine-based cleaning compositions etch silicon from the substrate. Employment of the preferred compositions of the present invention minimizes damage to the silicon in such substrates.

The drying step is carried out by any suitable means, for example, by isopropyl alcohol (IPA) vapor drying or by heat or centripetal force.

It will be appreciated by those skilled in the art that the cleaning composition of the present invention may be modified to achieve optimum cleaning without damaging the substrate so that high throughput cleaning can be maintained in the manufacturing process. For example, one skilled in the art would appreciate that, for example, modifications to the amounts of some or all of the components may be made depending upon the composition of the substrate being cleaned, the nature of the residue to be removed, and the particular process parameters used.

Although the present invention has been principally described in connection with cleaning semiconductor substrates, the cleaning compositions of the invention can be employed to clean any substrate that includes organic and inorganic residues.

EXAMPLES

The following examples are provided for the purpose of further illustrating the present invention but are by no means intended to limit the same.

General Procedure for Preparing the Cleaning Compositions

All compositions which are the subject of the present Examples were prepared by mixing 500 g of material in a 600 mL beaker with a 1" (2.5 cm) Teflon-coated stir bar. The liquid components can be added in any order prior to the solid component.

Compositions of the Substrate

Substrates used in the present Examples were Al metal lines and/or Al vias. The Al metal line substrate consisted of TiN/Al/TiN/Ti metallurgy and was patterned and etched by reactive ion etching (RIE). Photoresist was removed by oxygen plasma ashing. There was organometallic residue left on the metal lines substrate after ashing process. One Al via substrate which had via opening of 0.45 um in silicon oxide dielectric layer was etched using silicon oxide plasma etching process without oxygen plasma ashing. Bulk photoresist layer was left on the top of the silicon oxide. The other Al via substrate which had via opening of 1 um or 0.45 um in silicon oxide dielectric layer was etched using silicon oxide plasma etching process and ashed using oxygen plasma ashing process; residues remained on the side-wall and the top/bottom of the vias.

Processing Conditions

Cleaning tests were run using 300 mL of the cleaning compositions in a 400 mL beaker with a ½" (1.3 cm) round Teflon stir bar set at 600 rpm. The cleaning compositions were heated to the desired temperature on a hot plate if necessary. Wafer segments approximately ½"×½" (1.3 cm×1.3 cm) in size were immersed in the compositions at desired temperature for desired time.

The segments were then rinsed for 3 minutes in a DI water overflow bath and subsequently dried using filtered nitrogen. They were then analyzed for cleanliness using SEM microscopy.

Etch Rate Measurement Procedure

Clean coupons of the blanket Al wafer were measured for metal layer thickness by measuring the resistivity of the layer employing a ResMap™ model 273 resistivity instrument from Creative Design Engineering, Inc. (Long Island City, N.Y.). The coupons were then immersed in the composition at 60° C. (or at the temperature indicated in the tables) and at 5, 10, 20, 40 and 60 minutes the coupons were removed from the composition, rinsed with de-ionized water and dried and the thickness of the metal layer was again measured. (For the purposes of clarity, at 5 minutes the coupons were taken out of the composition, rinsed, dried and measured, then put back into the composition for another 5 minutes (at 10 minutes) taken out of the composition, rinsed, dried and measured, and then put back into the composition for another 10 minutes, (at 20 minutes) taken out of the composition, rinsed, dried and measured), and so on. The time when measurements were taken represents the total time the coupons were immersed in the composition. A graph of the change in thickness as a function of immersion time was made and the etch rate in Angstroms/min was determined from the slope of the curve.

Clean coupons of the blanket polysilicon wafer, which consist of 1000 Å polysilicon layer on thermal oxide/silicon substrate supplied by Montco Silicon Technology Inc., were measured for Si layer thickness by FilmTek™ 2000-SE spectroscopic Ellipsometer & Reflectometer. The coupons were then immersed in the composition at 60° C. (or at the temperature indicated in each of the tables) and at 5, 10, 20, 40 and 60 minutes, the coupons were removed from the composition, rinsed with de-ionized water and dried and the thickness of the metal layer was again measured. The time when measurements were taken represents the total time the coupons were immersed in the composition as described above. A graph of the change in thickness as a function of immersion time was made and the etch rate in Angstroms/min was determined from the slope of the curve.

Results

Table 1 shows compositions of Examples 1A and 2D, 2E, 2F, 2G, 49A, 49B and 49C, which are water-rich hydroxylamine formulations. The only difference in these compositions is different alkanolamine being used. It can be seen that the compositions with alkanolamines TEA, DEA, DIPA, NDEA surprisingly have minimum Si etch. The compositions with other commonly used alkanolamines, i.e., MIPA, MEA, NMEA and AEE have very high Si etch rate. The pKa of TEA, DEA, DIPA, NDEA are less than 9, the pKa of MIPA, MEA, NMEA and AEE are higher than 9. These results clearly demonstrate that in the water-rich hydroxylamine and alkanolamine containing compositions, employing alkanolamines with pKa<9 will protect the silicon substrate.

TABLE 1

Silicon etch rate for compositions with different alkanolamines

| Comp. | HA wt % | Alkanolamine wt % | Water wt % | Corrosion inhibitor wt % | Solvent wt % | *pKa | Neat pH | Si Etch rate (Å/min) at 45° C. |
|---|---|---|---|---|---|---|---|---|
| 1A | 5 | MIPA 15 | 56 | tBC 1 | PG 23 | 9.47 | 11.13 | 197 |
| 2D | 5 | TEA 15 | 56 | tBC 1 | PG 23 | 7.76 | 9.26 | <1 |
| 2E | 5 | MEA 15 | 56 | tBC 1 | PG 23 | 9.50 | 10.97 | >211 |
| 2F | 5 | NMEA 15 | 56 | tBC 1 | PG 23 | 9.88 | 11.09 | >209 |
| 2G | 5 | AEE 15 | 56 | tBC 1 | PG 23 | 9.5 | 10.76 | >200 |
| 49A | 5 | DEA 15 | 56 | tBC 1 | PG 23 | 8.95 | 10.47 | 1 |
| 49B | 5 | DIPA 15 | 56 | tBC 1 | PG 23 | 8.89 | nt | <1 |
| 49C | 5 | NDEA 15 | 56 | tBC 1 | PG 23 | 8.63 | 10.19 | <1 |

*pKa values of alkanolamines in water at 25° C., data sources: Handbook of Chemistry and Physics, 81st edition; Lange's Handbook of Chemistry, fifteenth edition; Huntsman Technical bulletin; Ind. Eng. Chem. Res. 2003, 42, 4414-4412

MIPA: isopropanolamine

TEA: triethanolamine

MEA: monoethanolamine

NMEA: N-methylethanolamine

AEE: aminoethoxyethanol

DEA: diethanolamine

DIPA: diisopropanolamine

NDEA: N-methyldiethanolamine tBC: t-butyl catechol

PG: Propylene glycol

Table 2 shows water-rich compositions with TEA have low Al and Si etch rate.

TABLE 2

| Comp. | HA wt % | Alkanolamine wt % | Water wt % | Corrosion inhibitor wt % | Solvent wt % | Neat pH | Al Etch rate (A/min) at 60° C. | Si Etch rate (Å/min) at 60° C. |
|---|---|---|---|---|---|---|---|---|
| 1F | 5 | MIPA 15 | 79 | tBC 1 | 0 | 10.97 | nt | 129 |
| 2D | 5 | TEA 15 | 56 | tBC 1 | PG 23 | 9.26 | nt | 1 |
| 2H | 5 | TEA 15 | 79 | tBC 1 | 0 | nt | 1 | 1 |
| 5A | 7.5 | TEA 20 | 71.5 | tBC 1 | 0 | 9.73 | 1 | <1 |
| 5B | 7.5 | TEA 20 | 72 | tBC 0.5 | 0 | 9.83 | 1 | 1 |
| 5F | 7.5 | TEA 25 | 67 | tBC 0.5 | 0 | 10.01 | 2 | <1 |
| 5H | 7.5 | TEA 30 | 62 | tBC 0.5 | 0 | 10.11 | 1 | <1 |
| 5I | 10 | TEA 20 | 69.5 | tBC 0.5 | 0 | 10.01 | 1 | 1 |
| 5J | 10 | TEA 25 | 64.5 | tBC 0.5 | 0 | 10.06 | <1 | 1 |

Table 3 shows that composition 5F has efficient cleaning capability for Al substrates and there is no need for intermediate rinse using the cleaning composition.

TABLE 3

Cleaning performance of composition 5F

| Al substrates | Temperature (° C.) | Time (min) | Cleaning performance | Al corrosion | intermediate rinse |
|---|---|---|---|---|---|
| Al via, etched | 60 | 20 | Good | no | No need |
| Al line, ashed | 65 | 20 | Good | no | No need |
| Al via, ashed | 65 | 20 | Good | no | No need |

Thus, the water-rich composition of HA and alkanolamine with pKa<9 demonstrate efficient cleaning and good compatibility with an Al substrate in which a silicon layer may and/or may not be exposed and low Al and Si etch rates. It also demonstrated that an intermediate IPA rinse step is not required.

The composition of Table 4 included a water-miscible solvent (propylene glycol, PG) and no alkanolamine.

TABLE 4

| Al and Si etch rate of compositions with PG | | | | | | | | |
|---|---|---|---|---|---|---|---|---|
| Comp. | HA wt % | Alkanolamine wt % | Water wt % | Corrosion inhibitor wt % | Solvent wt % | pH (5%) | Al Etch rate (A/min) at 70° C. | Si Etch rate (Å/min) at 70° C. |
| 42E | 10 | 0 | 69.5 | tBC 0.5 | PG 20 | 9.6 | 1 | <1 |

Table 5 summarizes the performance of the composition of Table 4.

TABLE 5

| Cleaning performance of composition 42E | | | | | |
|---|---|---|---|---|---|
| Al substrates | Temperature (° C.) | Time (min) | Cleaning performance | Al corrosion | intermediate rinse |
| Al line, ashed | 75 | 5 | Good | no | No need |
| Al via, ashed | 75 | 30 | Good | no | No need |

Thus, the water-rich composition of HA and PG demonstrates efficient cleaning and good compatibility with an Al substrate in which a silicon layer may and/or may not be exposed. It also demonstrated that an intermediate IPA rinse step is not required.

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A composition useful for removing residue from a semiconductor substrate comprising:

from about 2 to about 15% by wt. of hydroxylamine;

from about 50 to about 80% by wt. of water;

from about 0.01 to about 5.0% by wt. of corrosion inhibitor;

from about 5 to about 45% by wt. of a component selected from the group consisting of: one or more alkanolamines each having a pKa<9.0, propylene glycol, and a mixture thereof, wherein the alkanolamine is selected from the group consisting of: triethanolamine, diethanolamine, diisopropanolamine, N-methyldiethanolamine, and mixtures thereof; and wherein the corrosion inhibitor is selected from the group consisting of: one or more linear or branched C1-C6 alkyl dihydroxybenzenes, one or more hydroxyquinolines, and mixtures thereof.

2. A composition useful for removing residue from a semiconductor substrate comprising:

from about 2 to about 10% by wt. of hydroxylamine;

from about 55 to about 80% by wt. of water;

from about 0.01 to about 5.0% by wt. of corrosion inhibitor;

from about 5 to about 42% by wt. of a component selected from the group consisting of: one or more alkanolamines each having a pKa<9.0, propylene glycol, and a mixture thereof, wherein the alkanolamine is selected from the group consisting of: triethanolamine, diethanolamine, diisopropanolamine, N-methyldiethanolamine, and mixtures thereof; and wherein the corrosion inhibitor is selected from the group consisting of: one or more linear or branched C1-C6 alkyl dihydroxybenzenes, one or more hydroxyquinolines, and mixtures thereof.

3. The composition of claim 1 wherein the alkanolamine is triethanolamine.

4. The composition of claim 1 wherein the corrosion inhibitor is selected from the group consisting of: tert-butyl catechol, catechol, gallic acid, 2,3-dihydroxy naphthalene, 2,3-dihydroxy tetraline, and mixtures thereof.

5. The composition of claim 4 wherein the corrosion inhibitor is tert-butyl catechol.

6. The composition of claim 4 wherein said alkanolamine is triethanolamine.

7. The composition of claim 1 wherein the composition is solvent-free.

8. The composition of claim 1 consisting of:

from about 4 to about 10% by wt. of said hydroxylamine;

from about 60 to about 80% by wt. of said water;

from about 0.1 to about 5.0% by wt. of said corrosion inhibitor;

from about 10 to about 25% by wt. of said propylene glycol; and from about 0 to about 30% by wt. of said alkanolamine having a pKa<9.0, wherein the alkanolamine is selected from the group consisting of: triethanolamine, diethanolamine, diisopropanolamine, N-methyldiethanolamine, and mixtures thereof; and wherein the corrosion inhibitor is selected from the group consisting of: one or more linear or branched C1-C6 alkyl dihydroxybenzenes, one or more hydroxyquinolines, and mixtures thereof.

9. The composition of claim 8 wherein the alkanolamine is triethanolamine.

10. The composition of claim 8 wherein the corrosion inhibitor is selected from the group consisting of: tert-butyl catechol, catechol, gallic acid, 2,3-dihydroxy naphthalene, 2,3-dihydroxy tetraline, and mixtures thereof.

11. The composition of claim 10 wherein the corrosion inhibitor is tert-butyl catechol.

12. A method for removing residue from a substrate comprising aluminum and silicon, the method comprising the steps of:

contacting the substrate with a cleaning composition comprising:

from about 2 to about 10% by wt. of hydroxylamine;

from about 55 to about 80% by wt. of water;

from about 0.01 to about 5.0% by wt. of a corrosion inhibitor;

from about 5 to about 42% by wt. of a component selected from the group consisting of: an alkanolamine having a pKa<9.0, propylene glycol, and a mixture thereof, wherein the alkanolamine is selected from the group consisting of: triethanolamine, diethanolamine, diisopropanolamine, N-methyldiethanolamine, and mixtures thereof; and wherein the corrosion inhibitor is selected from the group consisting of: one or more linear or branched C1-C6 alkyl dihydroxybenzenes, one or more hydroxyquinolines, and mixtures thereof;

rinsing the substrate with water; and drying the substrate, wherein the method excludes an intermediate IPA (isopropyl alcohol) rinse step prior to the step of rinsing the substrate with water.

13. The method of claim 12 wherein the substrate is a semiconductor substrate, said composition comprises from about 2 to about 10% by weight of said hydroxylamine; from about 55 to about 80% by weight of said water, and 5 to about 42% by wt. of said component selected from the group consisting of: an alkanolamine having a pKa<9.0, propylene glycol, and a mixture thereof; and wherein the silicon etch rate is less than 20 Å/min for said method.

14. The method of claim 13 wherein the alkanolamine is triethanolamine.

15. The method of claim 12 wherein the corrosion inhibitor is selected from the group consisting of: 2-hydroxyquinoline, 4-hydroxyquinoline, 6-hydroxyquinoline, 8-hydroxyquinoline, and mixtures thereof.

16. The method of claim 12 wherein the corrosion inhibitor is selected from the group consisting of: tert-butyl catechol, catechol, gallic acid, 2,3-dihydroxy naphthalene, 2,3-dihydroxy tetraline, and mixtures thereof.

17. The method of claim 16 wherein the corrosion inhibitor is tert-butyl catechol.

18. The composition of claim 5 wherein said alkanolamine is triethanolamine.

19. The composition of claim 1, wherein said composition comprises about 5 to about 7.5% by wt. hydroxylamine;

from about 60 to about 70% by wt. of water; and from about 0.01 to about 1% by wt. of corrosion inhibitor.

20. The composition of claim 18, wherein said composition comprises about 5 to about 7.5% by wt. hydroxylamine;

from about 60 to about 70% by wt. of water; and from about 0.01 to about 1% by wt. of corrosion inhibitor.

21. The composition of claim 9 wherein the corrosion inhibitor is tert-butyl catechol.

* * * * *